US009459063B1

(12) United States Patent
Gatturna

(10) Patent No.: US 9,459,063 B1
(45) Date of Patent: Oct. 4, 2016

(54) AMMUNITION MAGAZINE LOADING DEVICE, SYSTEM, AND METHOD

(71) Applicant: Roland Francis Gatturna, Cape Coral, FL (US)

(72) Inventor: Roland Francis Gatturna, Cape Coral, FL (US)

( * ) Notice: Subject to any disclaimer, the term of this patent is extended or adjusted under 35 U.S.C. 154(b) by 0 days.

(21) Appl. No.: 15/091,271

(22) Filed: Apr. 5, 2016

(51) Int. Cl.
*F41A 9/83* (2006.01)
*F41A 9/65* (2006.01)

(52) U.S. Cl.
CPC ... *F41A 9/83* (2013.01); *F41A 9/65* (2013.01)

(58) Field of Classification Search
CPC ..... F41A 9/83; F41A 9/84; F41A 9/65; F41A 9/67; F41C 9/085
USPC ..... 42/87, 88, 90
See application file for complete search history.

(56) References Cited

U.S. PATENT DOCUMENTS 4,689,909 A * 9/1987 Howard ..... F41A 9/83 42/87
5,402,594 A 4/1995 Switzer
7,503,138 B2 3/2009 Tal et al.
7,637,048 B2 12/2009 Tal et al.
7,805,874 B2 10/2010 Tal et al.
8,650,792 B1 2/2014 Overmars
8,726,561 B1 5/2014 Hampton
9,057,570 B1 6/2015 Tal et al.
9,212,859 B1 12/2015 Tal
9,239,198 B2 1/2016 McPhee
2013/0232843 A1 9/2013 Bajuelo
2014/0033592 A1 2/2014 Fiorucci
2014/0230302 A1 8/2014 Crum et al.
2014/0373421 A1 12/2014 Hatch
2015/0027023 A1 1/2015 Michael et al.
2015/0075053 A1 3/2015 Kim

* cited by examiner

*Primary Examiner* — Reginald Tillman, Jr.
(74) *Attorney, Agent, or Firm* — George F. Wallace

(57) ABSTRACT

An ammunition magazine loading device for use with, and in combination with, an ammunition magazine, and a method of using the same. Such a device includes a base portion, a plunger having a first end extending from the base top and a second end terminating at first and second plunger extensions defining a pin slot therebetween, and a pin. At least one magazine side includes a pin aperture, the plunger is configured to abut and move a magazine follower below the pin aperture, and the pin is configured to be concurrently positioned through the pin aperture and the pin slot to statically position the follower in a lower position for rounds to then be added to the magazine.

18 Claims, 2 Drawing Sheets

FIG. 3a
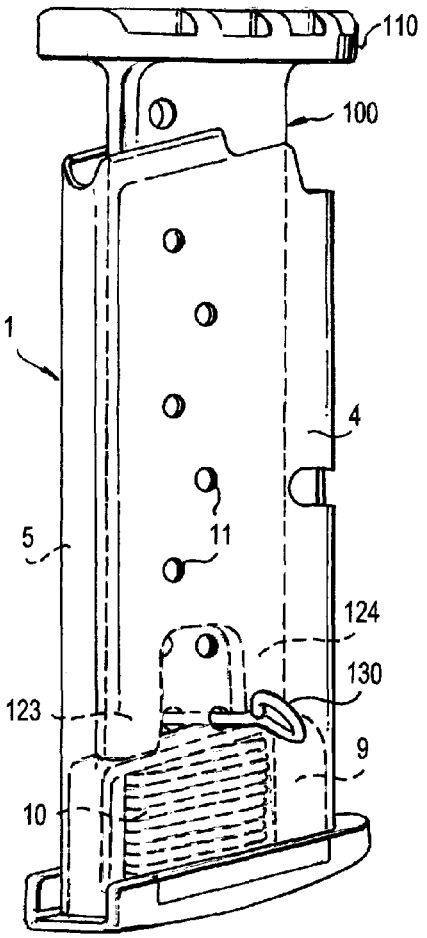
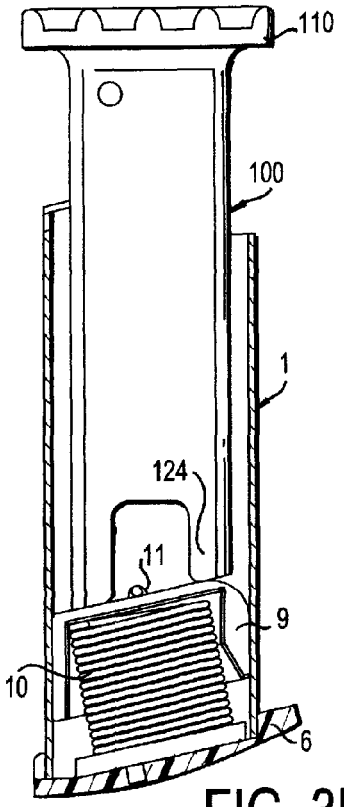
FIG. 3b
FIG. 4
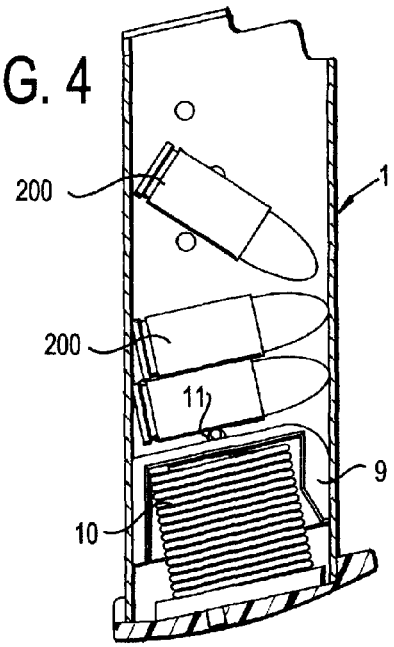
FIG. 5
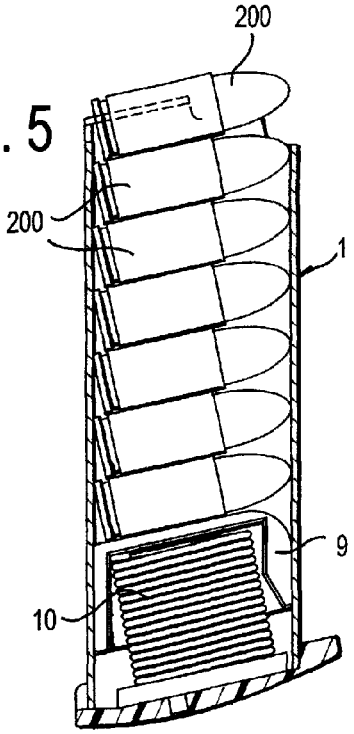

AMMUNITION MAGAZINE LOADING DEVICE, SYSTEM, AND METHOD

FIELD OF THE INVENTION

The present invention relates to ammunition magazines and ammunition magazine loaders.

BACKGROUND OF THE INVENTION

An ammunition magazine is a device used to provide rounds of ammunition to a firearm.

SUMMARY OF THE INVENTION

The present invention provides an ammunition magazine loading device, system, and method.

In an exemplary environment, such a loading device can be used in conjunction with a hollow ammunition magazine having front, rear, right, and left magazine sides, a magazine bottom, an open magazine top having a feed structure, a follower disposed within the ammunition magazine and between the feed structure and the magazine bottom, and at least one spring disposed within the ammunition magazine and between the magazine bottom and the follower.

In an exemplary embodiment, such a loading device can include a base portion having a base bottom and a base top; a plunger having a first end, connected to the base portion and extending from the base top, and a second end terminating at first and second plunger extensions defining a pin slot therebetween; and a pin. In exemplary aspects, at least one of the right and left magazine sides can include a pin aperture; the plunger is configured to abut and move the follower below the right and left pin apertures; and the pin is configured to concurrently pass through the pin aperture and the pin slot.

In another exemplary embodiment, an ammunition magazine system can include a hollow ammunition and a magazine loading device in combination.

In a further exemplary embodiment, an ammunition magazine loading method for loading a plurality of rounds into a hollow ammunition magazine with a magazine loading device can include the follows steps: aligning the loading device with the ammunition magazine such that first and second plunger extensions abut a follower; moving the ammunition magazine and the loading device towards each other such that the plunger moves the follower below a pin aperture in the ammunition magazine; inserting a pin through the pin aperture and a pin slot; removing the plunger from the ammunition magazine; sequentially inserting the plurality of rounds into the ammunition magazine; and withdrawing the pin from the pin aperture and the pin slot.

Any embodiment of the present invention can include one or more of the following exemplary optional aspects, the ammunition magazine can have a magazine width and the pin can have a pin length greater than the magazine width; the base bottom can have a flat profile; the pin can be configured to pass through the pin aperture and be positioned between the follower and the feed structure; the first plunger extension can be longer than the second plunger extension; and the first and second plunger extensions can have different lengths.

BRIEF DESCRIPTION OF THE DRAWINGS

FIG. 3*a* illustrates an exemplary magazine with an exemplary magazine loading device operationally engaged therewith.

FIG. 3*b* illustrates an additional view of an exemplary magazine with an exemplary magazine loading device engaged therewith.

FIG. 4 illustrates an exemplary ammunition magazine having an exemplary follower and exemplary spring statically positioned via an exemplary pin, with rounds being inserted into the magazine.

FIG. 5 illustrates an exemplary magazine fully loaded with rounds with an exemplary pin subsequently removed.

DETAILED DESCRIPTION

It is an object of the present invention to provide an ammunition magazine loading device, system, and method having a plurality of embodiments, which are described, and are to be broadly interpreted, via the disclosure herein.

It should be noted that this disclosure includes a plurality of embodiments each having a plurality of elements and/or aspects, and such elements and/or aspects need not necessarily be interpreted as being conjunctively required by one or more embodiments of the present invention. In particular, all combinations of elements and/or aspects can enable a separate embodiment of a patentable invention, which may be claimed with particularity in this or any future filed Patent Applications. Moreover, such elements and/or aspects disclosed herein, whether expressly or implicitly, are to be construed strictly as illustrative and enabling, and not necessarily limiting. Therefore, it is expressly set forth that any elements and/or aspects, independently or in any combination of one of more thereof, are merely illustratively representative of one or more embodiments of the present invention and are not to be construed as necessary in a strict sense.

Further, to the extent the same element and/or aspect is defined differently anywhere within this disclosure, whether expressly or implicitly, the broader definition is to take absolute precedence, with the distinctions encompassed by the narrower definition to be strictly construed as optional.

Illustratively, perceived benefits of the present invention can include functional utility, whether expressly or implicitly stated herein, or apparent herefrom. However, it is expressly set forth that these benefits are not intended as exclusive. Therefore, any explicit, implicit, or apparent benefit from the disclosure herein is expressly deemed as applicable to the present invention.

The present invention provides an ammunition magazine loading device, system, and method that can improve the manual insertion of ammunition rounds into a magazine, whether a single or multi-stack magazine, such as a double-stack magazine, for example and not in limitation.

Figure 1A:
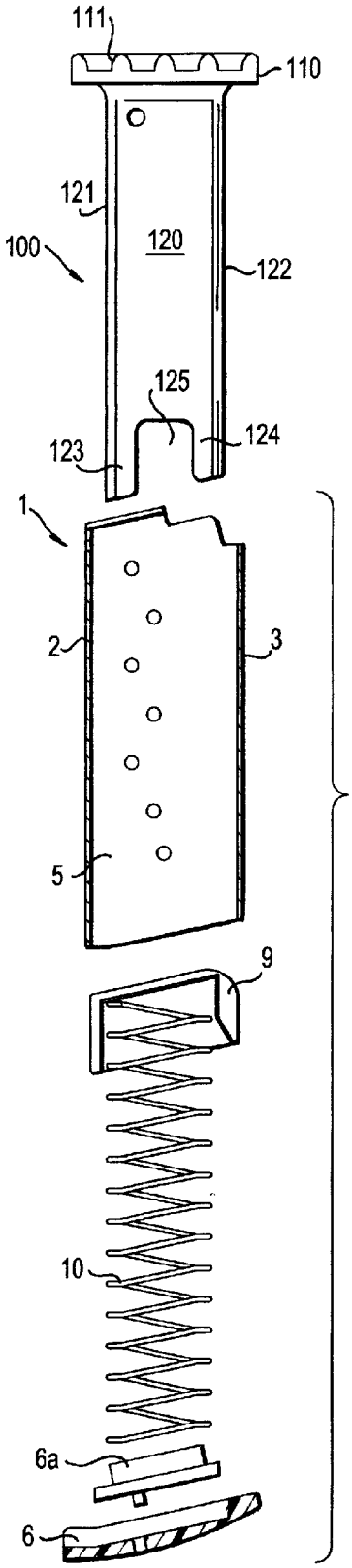
FIG. 1*a* illustrates an exploded view of an exemplary ammunition magazine loading device and an exemplary magazine having a follower, spring, optional insert, and an optionally removable magazine bottom.

As illustrated in FIG. 1*a*, an exemplary environment of an ammunition magazine loading device can include a hollow ammunition magazine 1 having front 2, rear 3, right 4, and left 5 magazine sides, a magazine bottom 6, an open magazine top 7 having a feed structure 8, a follower 9 disposed within the ammunition magazine and between the feed structure and the magazine bottom, and at least one spring 10 disposed within the ammunition magazine and between the magazine bottom and the follower. Notably, magazine 1 is illustratively shown as having a parallelepiped shape, however, any functionally compatible geometric shape or shapes can be provided, including ones having one or more curvilinear sides, to the extent desired and functionally compatible with the present invention. Further, each of the right and left magazine sides 4, 5 can include a plurality of pin apertures 11 with each aperture on the right magazine side having a corresponding aperture on the left magazine side, which can be seen in FIG. 3*a*; however, according to the present invention, at least one of the right and left sides can include at least one a pin aperture positioned at any desired point to achieve a desired position of a pin 130 disposed therethrough (further described infra).

Figure 1B:
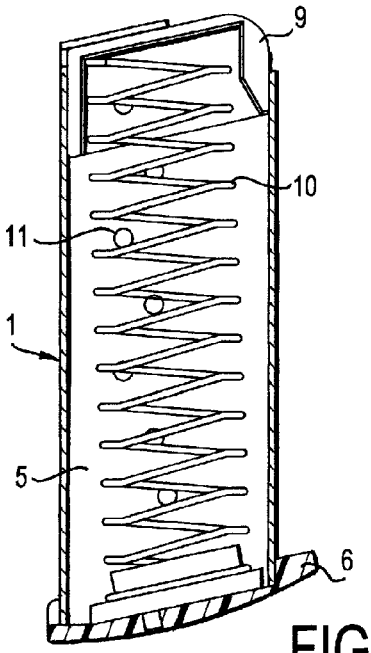
FIG. 1*b* illustrates an exemplary magazine having a follower, spring, optional insert, and magazine bottom in operational engagement.

FIG. 1*b* illustrates magazine 1 operatively assembled, in which spring 10 is disposed within the magazine and against (directly or indirectly) magazine bottom 6. Notably, an optional insert 6*a* is illustratively shown between spring 10 and bottom 6, which can optionally be provided to assist in statically positioning the spring during compression and decompression. Also notably, magazine bottom 6 can optionally be provided as removable to the extent desired. As further illustrated, operative assembly of magazine 1 can further include follower 9 disposed between spring 10 and top 7, with feed structure 8 acting as an abutment for the follower and rounds (see FIG. 5) within magazine 1 and assisting in maintaining their desired alignment during operation. Accordingly, as so configured, spring 10 biases follower 9 upwardly towards top 7. Further, feed structure 8 is illustratively shown as a pair of feed lips, however, the present invention contemplates the feed structure being provided with any desired shape or shapes insofar as functionally compatible with magazine 1.

Figure 2:
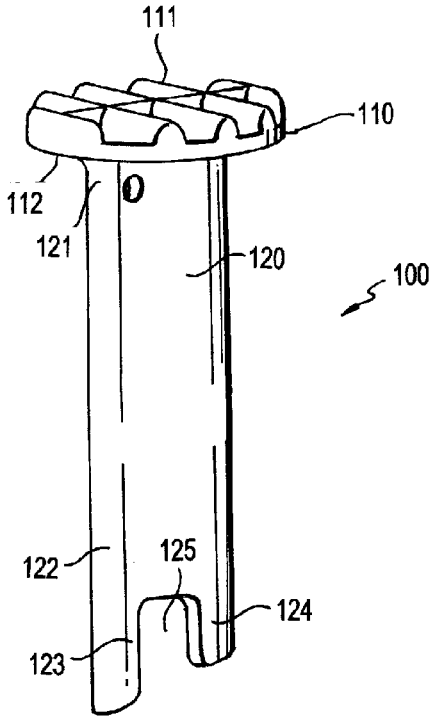
FIG. 2 illustrates an exemplary magazine loading device.

As illustrated by FIGS. 1*a* and 2, an exemplary ammunition magazine loading device 100 can include a base portion 110 having a base bottom 111 and a base top 112; a plunger 120 having a first end 121 connected to the base portion and extending from the base top, and a second end 122 terminating at first and second plunger extensions 123, 124 that define a pin slot 125 therebetween; and a pin 130.

In an exemplary aspect of the present invention, base bottom 111 can provide a contact area for moving device 100 towards magazine 1 or maintaining the device in a static position. For example and not in limitation, a user can place device 100 against the user's palm (not shown) or on a table top (not shown), for example and not in limitation. Optionally, as additionally illustrated, base bottom 111 can be provided with a flat profile such that device 100 can be self-standing and static when placed on a flat surface, such as a table or shooting bench, for example and not in limitation, which can allow a user to depress magazine 1 downwardly towards the static device, which can then move the follower downwardly within the magazine and compress spring 10.

In another exemplary aspect of the present invention, plunger 120 can be provided with a first end 121 connected to base portion 110 and extending from base top 112. According to the present invention, plunger 120 can be a separate structure attached to base top 112 (for example and not in limitation, via welding, adhesive, attachment structure, screw, etc.) or can be integral therewith (for example and not in limitation, via molding, machining, etc.). Further, plunger 120 can include a second end 122 terminating at first and second plunger extensions 123, 124 that define a pin slot 125 therebetween. Notably, while first and second plunger extensions 123, 124 are illustratively shown as having differing lengths and angled terminal portions to complementarily conform to the shape of follower 9, the present invention contemplates any desired shapes and/or lengths, insofar as the same are functionally compatible with the present invention. Further, plunger 120 can be provided with a linear shape or any combination of linear and curvilinear shapes to the extend desired and functionally compatible with the present invention.

In a further exemplary aspect of the present invention, pin 130 can be complementarily shaped to pass through one or more pin apertures 12, and can be provided with at least a pin length that allows the pin to pass through a pin aperture and be disposed within pin slot 125 when plunger 120 is desirably positioned within magazine 1. When so positioned, pin 130 can abut follower 9 and be positioned between follower 9 and feed structure 8, so as to prevent spring 10 from moving the follower beyond the pin position. Notably, the pin length can optionally be provided with a sufficient length to simultaneously pass through corresponding pin apertures 12 on right and left magazine sides 4, 5 and pin slot 125, in which case the pin length would be greater than the magazine width.

According to another exemplary embodiment of the present invention, an ammunition magazine loading system can include a magazine 1 and ammunition magazine loading device 100.

According to yet another exemplary embodiment of the present invention, an ammunition magazine loading method to load a plurality of rounds 200 into a hollow ammunition magazine 1, as described herein, with a magazine loading device 100, as described herein, can include the following steps: aligning the loading device with the ammunition magazine such that the first and second plunger extensions 123, 124 abut follower 9; moving at least one of the ammunition magazine and the loading device towards the other such that plunger 120 moves the follower below pin aperture 11; positioning pin 130 concurrently through the pin aperture and pin slot 125; removing the plunger from the ammunition magazine; sequentially inserting the plurality of rounds into the ammunition magazine; and withdrawing the pin from the pin aperture and the pin slot.

As illustrated in FIG. 1*a*, loading device 100 can be aligned with ammunition magazine 1 such that first and second plunger extensions 123, 124 face, and can subsequently abut, follower 9.

In an exemplary aspect of the present invention, after such alignment, as illustrated in FIGS. 3*a* and 3*b*, at least one of the ammunition magazine 1 and the loading device 100 can be moved towards the other such that plunger 120 moves follower 9 below pin aperture 11 and compresses spring 10 between the follower and magazine bottom 6. Notably, the location of pin aperture 11 can be selectively provided to allow follower 9 to be locked in place so as to allow sufficient space within magazine 1 to accept at least one round 200, and up to a full capacity of rounds. Notably, magazine 1 can be provided with one or more pin apertures 11 that are factory-provided, or can be modified to have one or more pin apertures, such as via drilling, for example and not in limitation.

In another exemplary aspect of the present invention, as illustrated in FIGS. 3*a* and 3*b*, pin 130 can then be positioned concurrently through pin aperture 11 and pin slot 125. Notably, as described above, where a second pin aperture 11 is provided on the opposite right or left side 4, 5, pin 130 can be further concurrently positioned through such a second pin aperture.

In still another exemplary aspect of the present invention, as illustrated in FIG. 4, with pin 130 so positioned, plunger 120 can be removed from magazine 1, and the pin can statically position follower 9 below pin aperture 11 notwithstanding the biasing force of spring 10. In one example, pin 130 and pin aperture 11 can be complimentarily sized (i.e., close in size) such that pin 130 can be statically positioned via angular abutment with the portion of right and or left sides 4, 5 defining the pin aperture, and thus, prevent follower 9 from moving towards magazine top 7. Alternatively or conjunctively, where an opposite pin aperture 11 is provided, arising stresses from spring 10 can be shared between right and left sides 4, 5.

In still another exemplary aspect of the present invention, as also illustrated in FIG. 4, with follower 9 statically positioned as such, rounds 200 can be sequentially inserted or dropped into magazine 1. In one example, rounds 200 can be inserted face-down to facilitate desired orientation.

In still a further exemplary aspect of the present invention, as illustrated in FIG. 5, after a desired number of rounds 200 are inserted into magazine 1, pin 130 can then be withdrawn from the one or more pin apertures 11 and pin slot 125, resulting in magazine 1 being loaded with rounds and ready for use with a firearm.

It should be noted that each element and/or aspect of the embodiments of an ammunition magazine loading device, system, and method described herein is expressly set forth as being potentially independently patentable without requiring another. Therefore, the inventor does not waive the right to seek patent protection for all combinations of one or more thereof.

Notably, in any embodiment of the present invention, the various elements can be provided in any desired shape and/or size that are functionally compatible with the present invention as described and/or claimed, and as expressly stated, are not limited to any particular shape or size illustratively described herein or apparent herefrom. Accordingly, exemplary shapes and/or sizes can include any shape or size having one or more geometric shapes, whether having symmetric or asymmetric portions, and without shape or size limitations relative to other elements unless necessary to the functionality of the present invention.

Further, it is expressly set forth that any structural element and/or aspect described herein can be formed from any one or more desired materials that provide functional compatibility with the respective component and/or the respective aspect related thereto. Thus, any one or more of a plastic, rubber, metal, wood, elastomer, crystalline material, man-made material, naturally-occurring material, synthetic, etc. may be utilized insofar as respectively compatible, including sufficient rigidity to overcome apparent stresses arising from anticipated use.

It will be apparent to one of ordinary skill in the art that the manner of making and using the claimed invention has been adequately disclosed in the above-written description of the exemplary embodiments and aspects.

It should be understood, however, that the invention is not necessarily limited to the specific embodiments, aspects, arrangement, and components shown and described above, but may be susceptible to numerous variations within the scope of the invention.

Therefore, the specification and drawings are to be regarded in an illustrative and enabling, rather than a restrictive, sense.

Accordingly, it will be understood that the above description of the embodiments of the present invention are susceptible to various modifications, changes, and adaptations, and the same are intended to be comprehended within the meaning and range of equivalents of the appended claims.

Therefore, I claim:

1. A magazine loading device for use with a hollow ammunition magazine having front, rear, right, and left magazine sides, a magazine bottom, an open magazine top having a feed structure, a follower disposed within the ammunition magazine and between the feed structure and the magazine bottom, and at least one spring disposed within the ammunition magazine and between the magazine bottom and the follower, said loading device comprising:

a base portion having a base bottom and a base top;

a plunger having a first end, connected to said base portion and extending from the base top, and a second end terminating at first and second plunger extensions defining a pin slot therebetween; and a pin;

wherein at least one of the right magazine side and the left magazine side includes a pin aperture, said plunger is configured to abut and move the follower below the pin aperture, and said pin is configured to be concurrently positioned through the pin aperture and the pin slot.

2. The magazine loading device of claim 1, wherein the ammunition magazine has a magazine width and said pin has a pin length greater than the magazine width.

3. The magazine loading device of claim 1, wherein the base bottom has a flat profile.

4. The magazine loading device of claim 1, wherein said plunger is configured to push the follower beyond the pin aperture, and said pin is configured to pass through the pin aperture and be positioned between the follower and the feed structure.

5. The magazine loading device of claim 1, wherein the first plunger extension is longer than the second plunger extension.

6. The magazine loading device of claim 1, wherein the first and second plunger extensions have different lengths.

7. An ammunition magazine loading system, comprising:

a hollow ammunition magazine having front, rear, right, and left magazine sides, a magazine bottom, an open magazine top having a feed structure, a follower disposed within said ammunition magazine and between the feed structure and the magazine bottom, and at least one spring disposed within said ammunition magazine and between the magazine bottom and the follower;

a magazine loading device having a base portion with a base bottom and a base top, a plunger having a first end, connected to the base portion and extending from the base top, and a second end terminating at first and second plunger extensions defining a pin slot therebetween, and a pin;

wherein at least one of the right and left magazine sides includes a pin aperture, the plunger is configured to abut and move the follower below the pin aperture, and the pin is configured to be concurrently positioned through the pin aperture and the pin slot.

8. The ammunition magazine system of claim 7, wherein said ammunition magazine has a magazine width and the pin has a pin length greater than the magazine width.

9. The ammunition magazine system of claim 7, wherein the base bottom has a flat profile.

10. The ammunition magazine system of claim 7, wherein the plunger is configured to push the follower beyond the right and left pin apertures, and the pin is configured to pass through the right and left pin apertures and be positioned between the follower and the feed structure.

11. The ammunition magazine system of claim 7, wherein the first plunger extension is longer than the second plunger extension.

12. The ammunition magazine system of claim 7, wherein the first and second plunger extensions have different lengths.

13. An ammunition magazine loading method to load a plurality of rounds into a hollow ammunition magazine with a magazine loading device, the ammunition magazine having front, rear, right, and left magazine sides with at least one of the right and left magazine side has a pin aperture, a magazine bottom, an open magazine top having a feed structure, a follower disposed within said ammunition magazine and between the feed structure and the magazine bottom, and at least one spring disposed within the ammunition magazine and between the magazine bottom and the follower, and the magazine loading device having a base portion with a base bottom and a base top, a plunger having a first end connected to, and extending from, the base top, and a second end terminating at first and second plunger extensions defining a pin slot therebetween, and a pin, said method comprising:

aligning the loading device with the ammunition magazine such that the first and second plunger extensions abut the follower;

moving at least one of the ammunition magazine and the loading device towards the other of the ammunition magazine and the loading device such that the plunger moves the follower below the right and left pin apertures;

positioning the pin concurrently through the pin aperture and the pin slot;

removing the plunger from the ammunition magazine;

sequentially inserting the plurality of rounds into the ammunition magazine; and withdrawing the pin from the pin aperture and the pin slot.

14. The method of claim 13, wherein the ammunition magazine has a magazine width and the pin has a pin length greater than the magazine width.

15. The method of claim 13, wherein the base bottom has a flat profile.

16. The method of claim 13, wherein the pin is configured to pass through the pin aperture and be positioned between the follower and the feed structure.

17. The method of claim 13, wherein the first plunger extension is longer than the second plunger extension.

18. The method of claim 13, wherein the first and second plunger extensions have different lengths.

* * * * *